US005249110A

United States Patent [19]

Russello et al.

[11] Patent Number: 5,249,110

[45] Date of Patent: Sep. 28, 1993

[54] LIGHT FIXTURE WITH ADJUSTABLE BULB AND RADIANT HEAT DISSIPATING REFLECTOR

[75] Inventors: Thomas Russello, Howell; Richard Sangiamo, Linden, both of N.J.

[73] Assignee: The Genlyte Group Incorporated, Secaucus, N.J.

[21] Appl. No.: 965,221

[22] Filed: Oct. 23, 1992

[51] Int. Cl.[5] ..... F21V 7/20; F21V 13/06

[52] U.S. Cl. ..... 362/294; 362/298; 362/300; 362/345; 362/346

[58] Field of Search ..... 362/294, 297, 298, 290, 362/342, 345, 346, 347, 299, 300

[56] References Cited

U.S. PATENT DOCUMENTS

| | | | |
|---|---|---|---|
| 1,388,221 | 8/1921 | Toepfer | 362/342 |
| 1,539,131 | 5/1925 | Carley | 362/342 |
| 3,852,588 | 12/1974 | Crawford | 362/342 |
| 4,112,483 | 9/1978 | Small, Jr. et al. | 362/298 |
| 4,254,456 | 3/1981 | Grindle et al. | 362/300 |
| 4,310,876 | 1/1982 | Small, Jr. et al. | 362/298 |
| 4,422,135 | 12/1983 | McCamy | 362/298 |
| 4,794,501 | 12/1988 | Bartenbach | 362/298 |
| 4,970,634 | 11/1990 | Howell et al. | 362/342 |

*Primary Examiner*—Richard R. Cole

*Attorney, Agent, or Firm*—Kane, Dalsimer, Sullivan, Kurucz, Levy, Eisele and Richard

[57] ABSTRACT

A light fixture includes a primary double arcuate buttocks-shaped reflector facing either a secondary double arcuate buttocks-shaped ("baby's bottom") reflector or a sieve-like reflector with lateral heat fins with a bulb therebetween. This system of reflectors emanates a large percentage of the visible light while absorbing a substantial percentage of the radiant energy and dissipating this radiant energy through the metal frame of the light fixture. The bracket for the socket for the bulb includes two parallel slots, perpendicular to the reflectors, to allow the bulb to be positioned between the reflectors.

13 Claims, 6 Drawing Sheets

LIGHT FIXTURE WITH ADJUSTABLE BULB AND RADIANT HEAT DISSIPATING REFLECTOR

This application is related to application Ser. No. 07/965,229, filed Oct. 23, 1992, entitled "Light Fixture with Detachable Rear Mounting Box" and to application Ser. No. 07/965,209, filed Oct. 23, 1992, entitled "Light Fixture With a Reversible Lens with Adjustable Brackets".

BACKGROUND OF THE INVENTION

1. Field of the Invention

This invention pertains to a light fixture with a sieve-shaped or double arcuate reflector and a bulb with a socket with an adjustable position.

2. Description of the Prior Art

In the prior art of light fixtures, it has been difficult to use a high wattage bulb with a plastic lens because the heat generated by the bulb has tended to deform the lens or discolor the lens to yellow or brown thereby decreasing light transmission. However, the use of a glass lens is not desirable due to the tendency of glass lenses to break, as well as being very heavy and bulky.

OBJECTS AND SUMMARY OF THE INVENTION

It is therefore an object of this invention to provide reflectors for a light fixture which will direct the radiant energy away from a plastic lens while transmitting a large portion of the visible light through the plastic lens so as to be usable.

It is therefore a further object of this invention to provide a way to adjust the position of the bulb of a light fixture so that the achievement of the above objects is optimized.

The invention includes a large double arcuate buttocks-shaped reflector in combination with either a small secondary double arcuate buttocks-shaped ("baby's bottom") reflector or a sieve-like reflector with heat fins. The invention further includes a double slot arrangement into which the bulb socket is screwed so as to provide a means for the adjustment of the bulb position to achieve the above objects.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
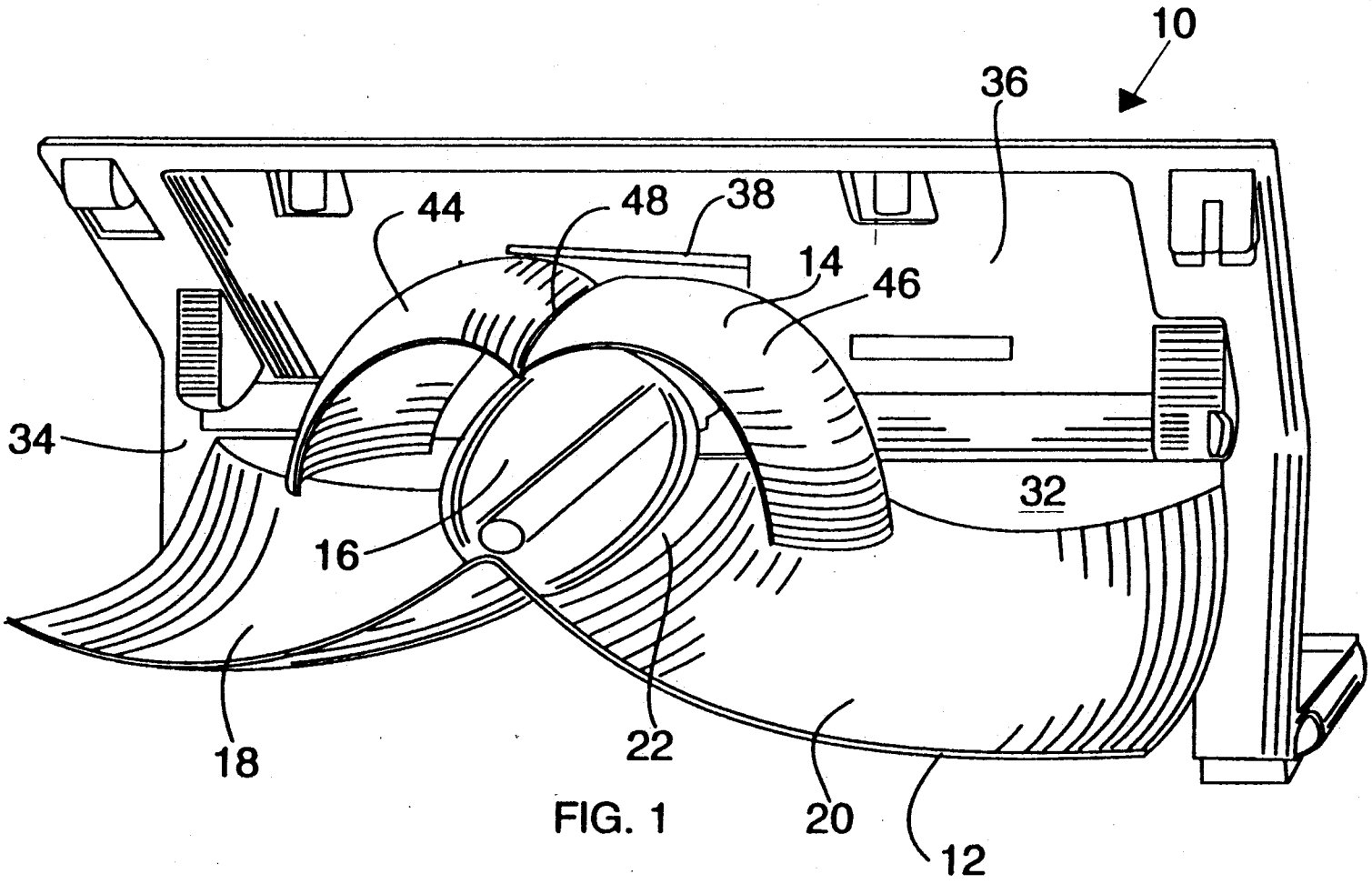
FIG. 1 is a perspective view of the primary double arcuate reflector, the secondary double arcuate reflector and the bulb.

Referring now to the drawings in detail wherein like numerals refer to like elements throughout the several views, FIG. 1 is a perspective view of the primary double arcuate buttocks-shaped reflector 12, the secondary double arcuate buttocks-shaped ("baby's bottom") reflector 14 and bulb 16 as parts of light fixture 10. Light fixture 10 is preferably of the type disclosed in commonly owned application Ser. No. 07/965,229, filed Oct. 21, 1992, entitled "Light Fixture with Detachable Rear Mounting Box", and commonly owned application Ser. No. 07/965,209, filed Oct. 23, 1992, entitled "Light Fixture with a Reversible Lens with Adjustable Brackets", the disclosures of which are incorporated herein by reference.

Figure 3:
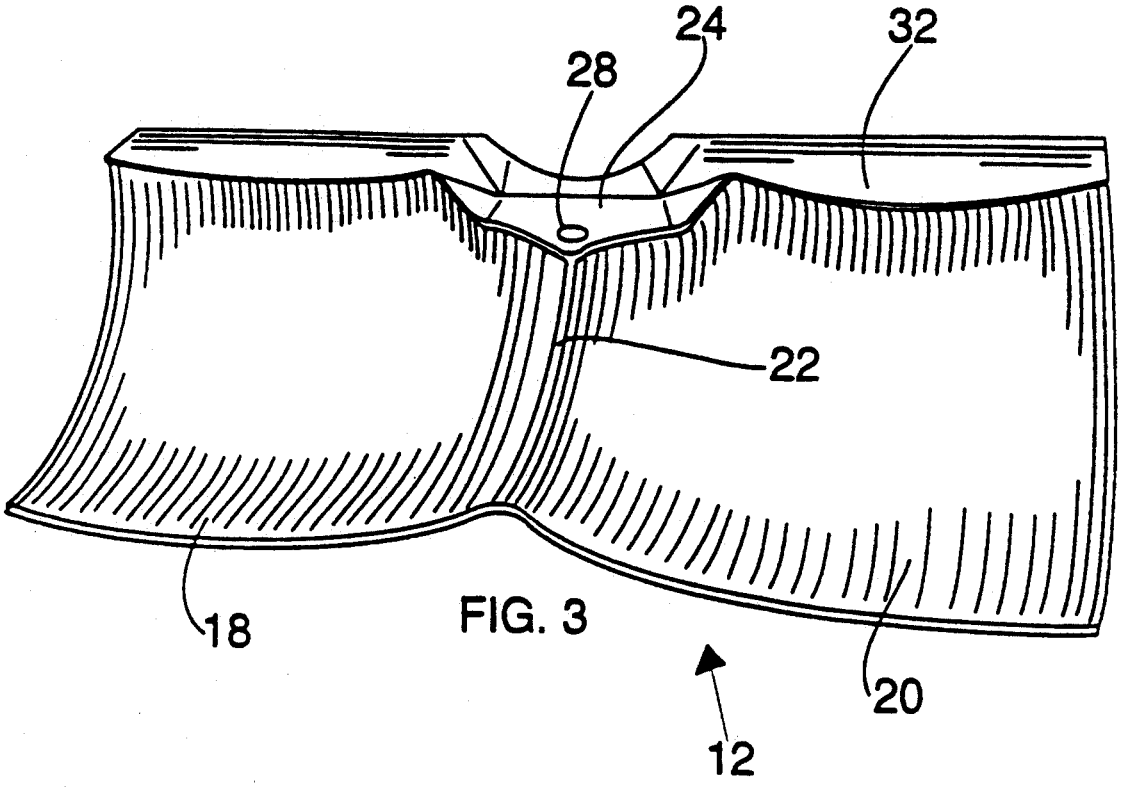
FIG. 3 is a perspective view of the primary double arcuate reflector.

As shown in FIGS. 1 and 3, primary double arcuate buttocks-shaped reflector 1 includes first arcuate section 18 and second arcuate section 20, with a curved apex 22 formed therebetween which maintains a constant distance (or "tracks") the profile of bulb 16. This constant distance between apex 22 and bulb 16 prevents any portion of bulb 16 from contacting primary double arcuate buttocks-shaped reflector 12 and creating hot spots on reflector 12.

Primary double arcuate buttocks-shaped reflector 12 further includes first planar portion 24 at an upper portion of apex 22 for engaging a corresponding planar portion (not shown) on fixture 10. First planar portion 24 includes aperture 28 for a bolt (not shown) to engage a corresponding aperture (not shown) in fixture 10 so as to secure reflector 12 to fixture 10. Primary double arcuate buttocks-shaped reflector 12 further includes second planar portion 32 to engage horizontal planar portion 34 of fixture 10 thereby positioning primary double arcuate buttocks-shaped reflector 12.

Figure 4:
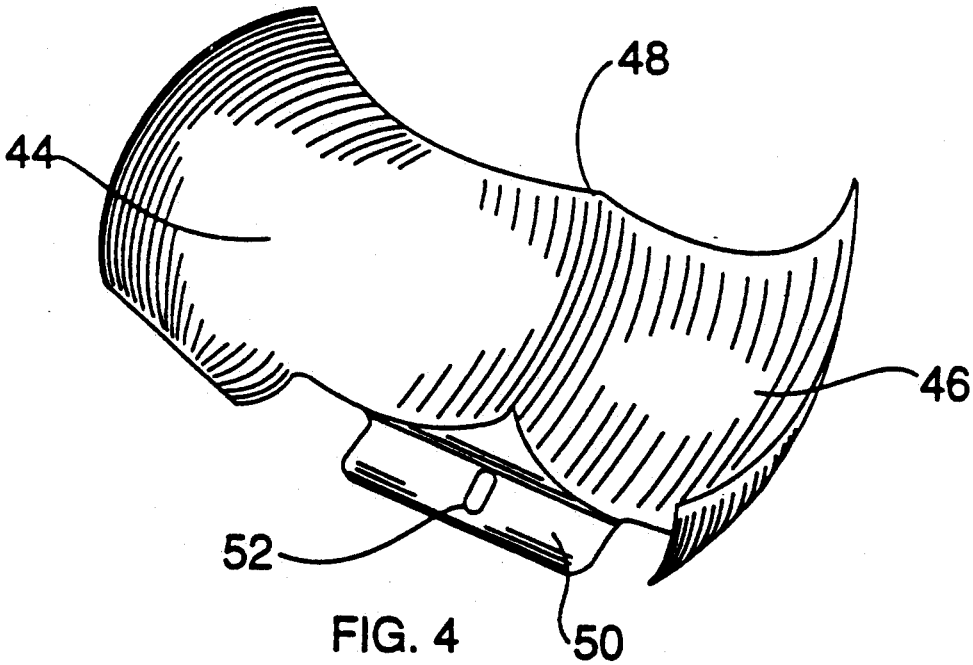
FIG. 4 is a perspective view of the secondary double arcuate reflector.

Light fixture 10 further includes slanted portion 36 which includes vertical slot 38 with a threaded aperture (not shown). As shown in FIGS. 1 and 4, secondary double arcuate buttocks-shaped ("baby's bottom") reflector 14 includes first arcuate section 44 and second arcuate section 46 with curved apex 48 therebetween. The interior portions of first and second arcuate sections 44, 46 are generally cylindrical whereas the outer portions of first and second arcuate sections 44, 46 are in transition from a spherical to a cylindrical shape in that a vertical cross section of arcuate sections 44, 46 tends to be straighter and less curved at its outer segments as compared to its inner segments. Curved apex 48, similar to curved apex 22, maintains a constant distance (or "tracks") the profile of bulb 16 in order to prevent hot spots from forming on reflector 14. At the upper portion of curved apex 48 is plate 50 with aperture 52 therein which is used engage vertical slot 38 and the threaded aperture (not shown) therein by bolt 54 (see FIG. 8).

The focal points of both first arcuate section 44 and second arcuate section 46 intersect at a focal point immediately forward of a substantial mid-point of curved apex 48. This focal point further corresponds to the central axis of bulb 16 wherein the filament is located. This allows arcuate sections 44, 46 of secondary double arcuate buttocks-shaped ("baby's bottom") reflector 14 to reflect visible light to arcuate sections 18, 20 which, in turn, reflect the light through lens 17 (see FIG. 8) to the environment with very little reflective loss of visible light. However, a large fraction of radiant energy incident from bulb 16 is absorbed by reflectors 12, 14 and dissipated as heat via the large metal surfaces of reflectors 12, 14 and light fixture 10 thereby preventing excessive heat build-up on lens 17.

Figure 2:
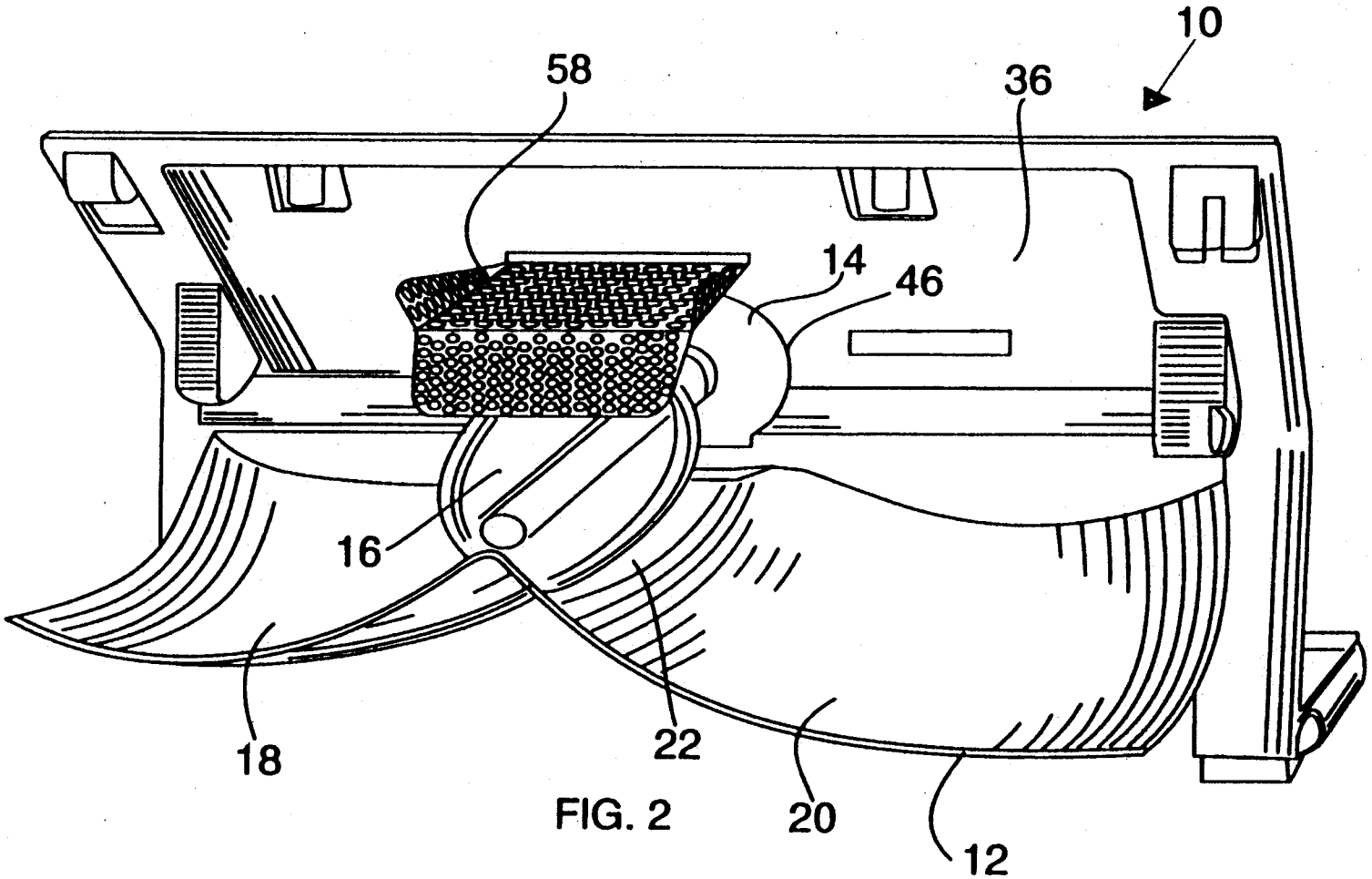
FIG. 2 is a perspective view of the primary double arcuate reflector, the sieve reflector and the bulb.
Figure 5:
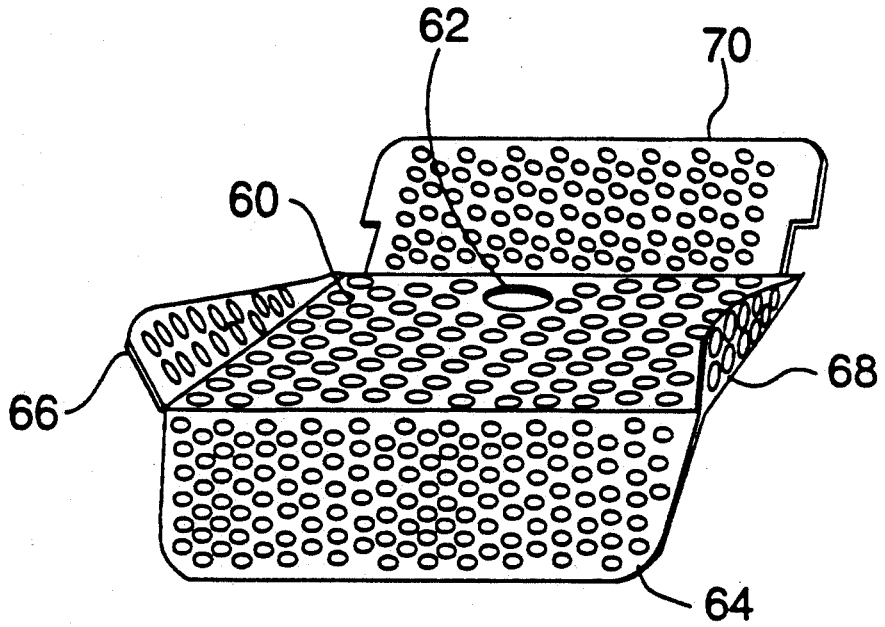
FIG. 5 is a perspective view of the sieve reflector.

Similarly, as shown in FIGS. 2 and 5, sieve reflector 58 can be substituted for secondary double arcuate buttocks-shaped ("baby's bottom") reflector 14. Sieve reflector 58 includes main planar portion 60 with aperture 62 (see FIG. 5) in an upper portion thereof, lower inclined reflector portion 64, lateral heat fins 66, 68 and upper inclined heat fin 70. All elements 60, 64, 66, 68, 70 of sieve reflector 58 are composed of perforated metal. Aperture 62 is directly analogous to aperture 52 and is used to engage sieve reflector 58 to vertical slot 38 via bolt 54 (see FIG. 8).

Sieve reflector 58 allows a portion of the visible light to pass through the perforations therein and thereafter through lens 17. The remaining portion of the visible light is reflected by the solid portions of sieve reflector 58 onto arcuate sections 18, 20 of primary double arcuate buttocks-shaped reflector 12 and thereafter through lens 17. However, radiant energy, by and large, does not emanate (i.e., reflect from or pass through) from sieve reflector 58, but is absorbed by sieve reflector 58. This heat is dissipated through the various portions of sieve reflector 58, including lateral heat fins 66, 68, and further through the large metal surfaces of light fixture 10.

Figure 6:
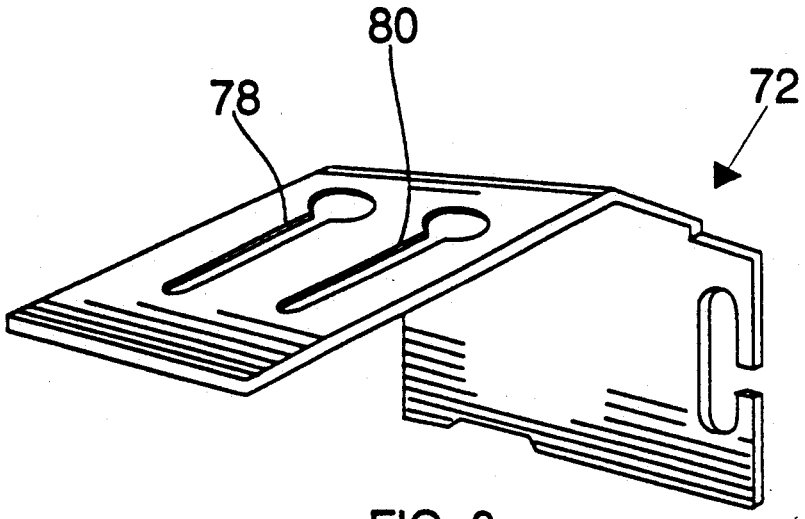
FIG. 6 is a perspective view of the double slot socket attachment.
Figure 7:
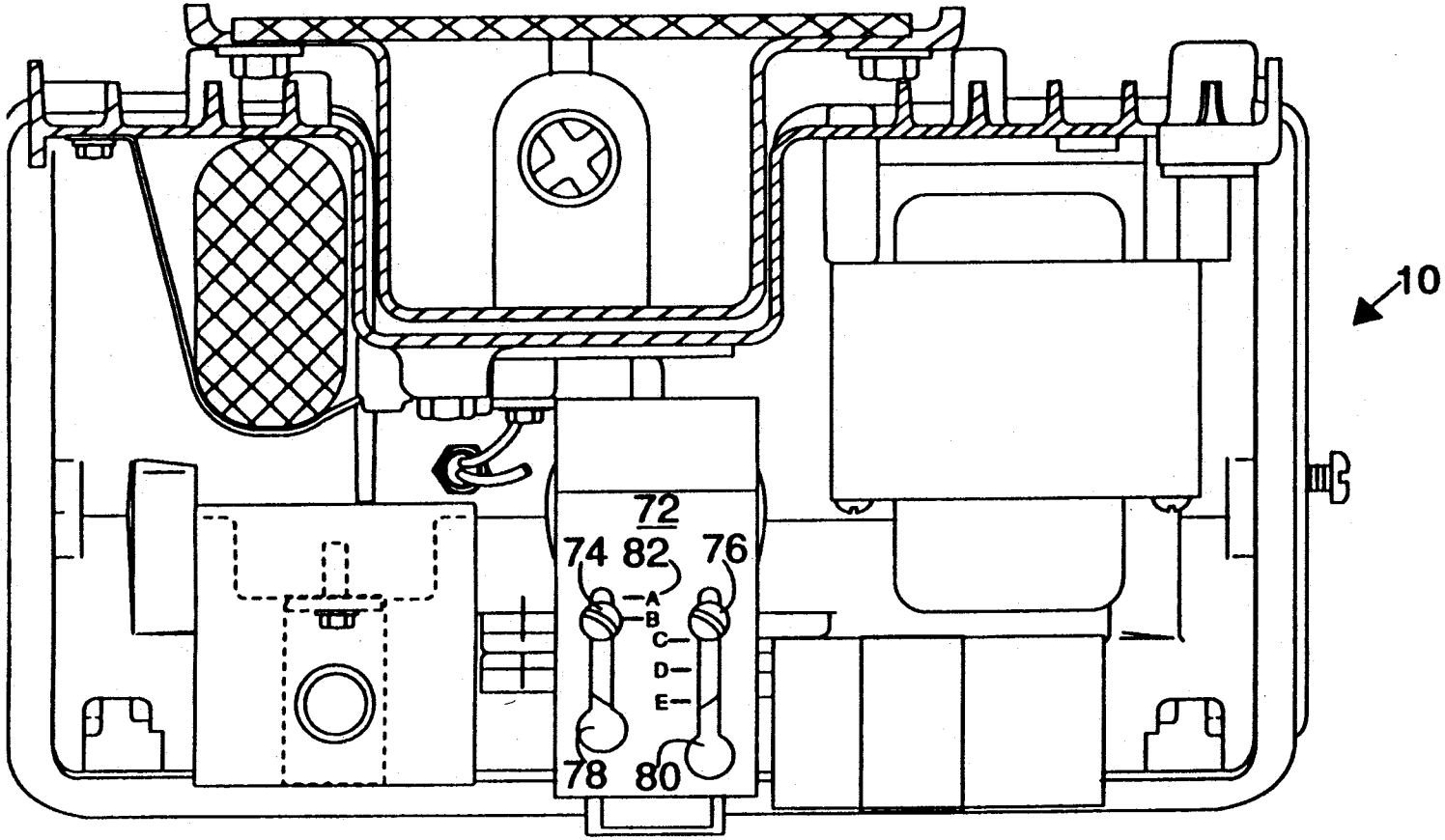
FIG. 7 is a top plan view of the light fixture showing the double slot socket attachment.
Figure 8:
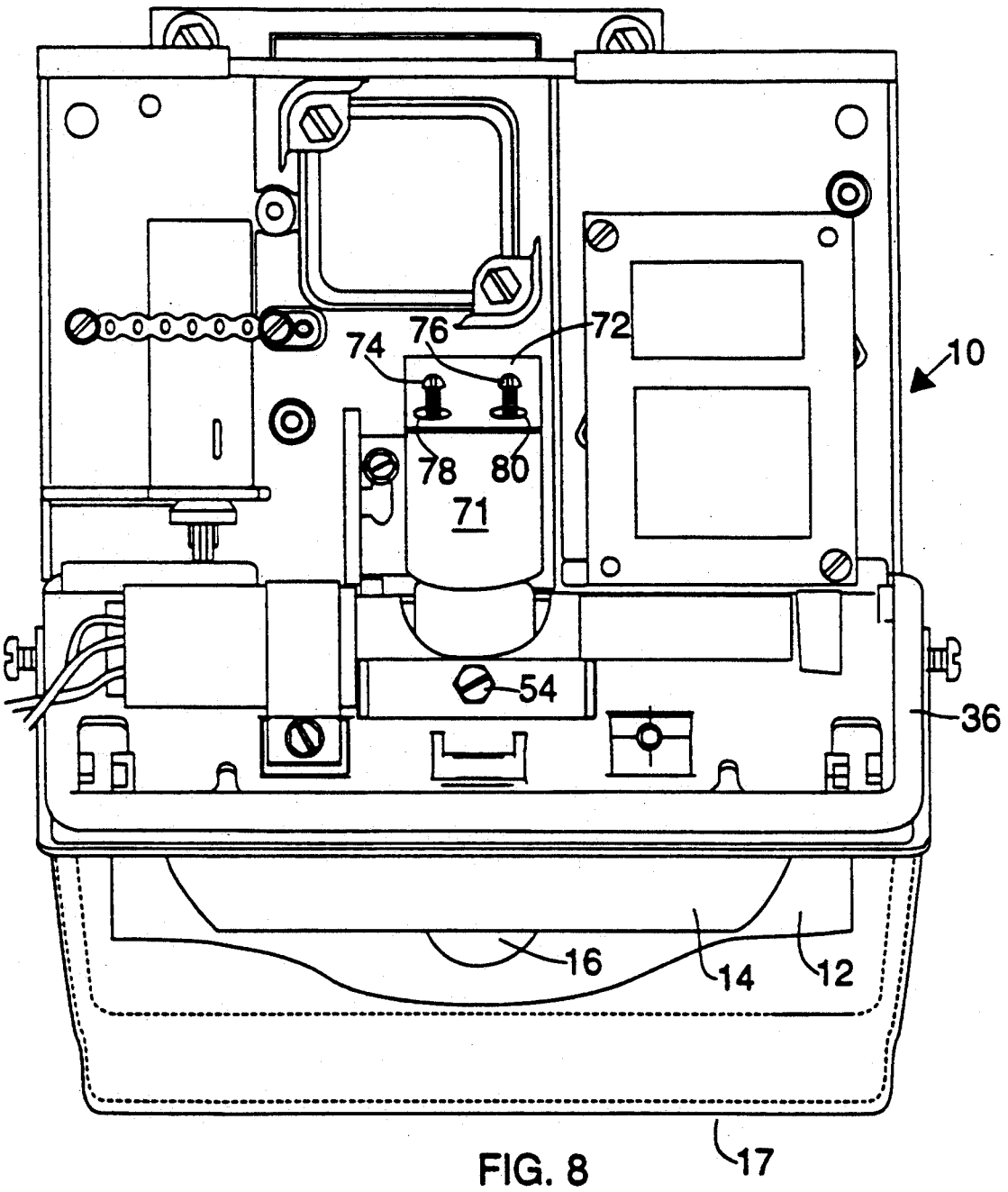
FIG. 8 is a front plan view of the light fixture showing the double slot socket attachment.

As shown in FIGS. 6, 7 and 8, in order that bulb 16 can be precisely positioned between curved apices 22, 48, socket 71 of bulb 16 is fastened to light fixture 10 by double slotted bracket 72. Bolts 74, 76 pass through slots 78, 80, respectively in bracket 72. Laterally adjacent to slots 78, 80 are indices 82 (such as "A", "B", "C", etc.) which allow the user to reproducibly position bolts 74, 76 and hence socket 71 and bulb 16 to a fixed location.

To use light fixture 10, the user attaches primary double arcuate buttocks-shaped reflector 12 and either secondary double arcuate buttocks-shaped ("baby's bottom") reflector 14 or sieve reflector 58. The user then adjusts the position of bulb 16 between curved apices 22, 48 by adjusting the position of bolts 74, 76 within slots 78, 80.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A light fixture of the type including a bulb, a reflector means proximate to said bulb and a lens proximate to said bulb and said reflector, the improvement wherein said reflector means includes a primary double arcuate reflector comprising a first arcuate section and a second arcuate section with a first apex therebetween adjacent to said bulb; and a secondary double arcuate reflector interposed between said lens and said bulb facing said primary double arcuate reflector with said bulb therebetween, said secondary double arcuate reflector being formed of a heat dissipative material and including a third arcuate section and a fourth arcuate section with a second apex therebetween adjacent to said bulb and wherein said first apex and said second apex are curved so as to maintain a substantially constant distance from said bulb.

2. The improvement of claim 1 wherein said third arcuate portion faces said first arcuate portion and said fourth arcuate portion faces said second arcuate portion.

3. The improvement of claim 2 wherein said third and fourth arcuate portions include substantially spherical segments at an interior thereof and substantially transitional cylindrical segments at lateral ends thereof.

4. The improvement of claim 3 wherein said second double arcuate reflector includes an upwardly extending portion with an aperture therein for engaging a vertical slot in the lighting fixture.

5. The improvement of claim 2 further including means for adjusting a position of said bulb between said first apex and said second apex.

6. The improvement of claim 5 wherein said means for adjusting includes a bracket including two parallel slots through which a bolt means extends and engages a socket which engages said bulb, wherein said slots are perpendicular to said first and second double arcuate reflectors and a position of said socket can be adjusted along said parallel slots.

7. A light fixture of the type including a bulb, a reflector means proximate to said bulb and a lens proximate to said bulb and said reflector, the improvement wherein said reflector means includes a double arcuate reflector comprising a first arcuate section and a second arcuate section with an apex therebetween adjacent to said bulb; and a secondary reflector facing said double arcuate reflector with said bulb therebetween, said secondary reflector comprised of a material including a repeating pattern of a plurality of apertures thereby forming a sieve structure which emanates a percentage of incident visible light which is higher than an emanated percentage of incident radiant energy.

8. The improvement of claim 7 wherein said apex is curved so as to maintain a substantially constant distance from said bulb.

9. The improvement of claim 8 wherein said secondary reflector includes a first planar portion and a second planar portion, said first and second planar portions facing said bulb and forming an obtuse angle therebetween.

10. The improvement of claim 8 wherein said secondary reflector includes lateral heat fins facing obliquely away from said secondary reflector.

11. The improvement of claim 10 wherein said secondary reflector includes an upwardly extending portion with an aperture therein for engaging a vertical slot in the lighting fixture.

12. The improvement of claim 8 further including means for adjusting a position of said bulb relative to said apex.

13. The improvement of claim 12 wherein said means for adjusting includes a bracket including two parallel slots through which bolt means extend and engage a socket which engages said bulb, wherein said slots are perpendicular to said double arcuate reflector and a position of said socket can be adjusted along said parallel slots.

* * * * *